US007700036B2

(12) United States Patent
Sipila et al.

(10) Patent No.: US 7,700,036 B2
(45) Date of Patent: Apr. 20, 2010

(54) LAUNDER FOR CASTING MOLTEN COPPER

(75) Inventors: Jussi Sipila, Espoo (FI); Juha Lumppio, Espoo (FI)

(73) Assignee: Outotec Oyj, Espoo (FI)

( * ) Notice: Subject to any disclaimer, the term of this patent is extended or adjusted under 35 U.S.C. 154(b) by 120 days.

(21) Appl. No.: 11/722,868

(22) PCT Filed: Dec. 29, 2005

(86) PCT No.: PCT/FI2005/000555

§ 371 (c)(1),
(2), (4) Date: Jun. 26, 2007

(87) PCT Pub. No.: WO2006/070057

PCT Pub. Date: Jul. 6, 2006

(65) Prior Publication Data

US 2009/0078723 A1 Mar. 26, 2009

(30) Foreign Application Priority Data

Dec. 30, 2004 (FI) ..... 20041686

(51) Int. Cl.
*B22D 35/06* (2006.01)

(52) U.S. Cl. ..... 266/196; 266/45

(58) Field of Classification Search ..... 222/591–593; 266/45, 44, 196

See application file for complete search history.

(56) References Cited

U.S. PATENT DOCUMENTS

| | | | | | |
|---|---|---|---|---|---|
| 3,954,388 | A | * | 5/1976 | Hildebrand | 431/329 |
| 4,219,188 | A | * | 8/1980 | Meier | 266/236 |
| 5,263,471 | A | * | 11/1993 | Shimek et al. | 126/528 |

FOREIGN PATENT DOCUMENTS

| | | | |
|---|---|---|---|
| DE | 3828515 | | 3/1990 |
| EP | 0011696 | | 6/1980 |
| GB | 2041411 | | 9/1980 |
| JP | 61052327 | | 3/1986 |
| JP | 07-100630 | * | 4/1995 |
| JP | 7100630 | | 6/2007 |

* cited by examiner

*Primary Examiner*—Scott Kastler
(74) *Attorney, Agent, or Firm*—Chernoff, Vilhauer, McClung & Stenzel

(57) ABSTRACT

The invention relates to a launder construction for the conveyance of molten metal. The metal flows in the lower part of the launder construction in a channel defined by a refractory mass, the launder being heat-insulated so that, in operating conditions, the metal forms a solid zone in the porous refractory mass. The essential features of the launder construction include a cover part that is provided with electrical resistors, ensuring that the metal remains melted and the launder sufficiently hot throughout the process, and a gas burner that prevents the metal from cooling under the effect of the gas flowing in the launder channel.

16 Claims, 4 Drawing Sheets

LAUNDER FOR CASTING MOLTEN COPPER

This is a national stage application filed under 35 USC 371 based on International Application No. PCT/FI2005/000555 filed Dec. 29, 2005, and claims priority under 35 USC 119 of Finnish Patent Application No. 20041686 filed Dec. 30, 2004.

The invention relates to a launder used in manufacturing and casting molten metal, such as copper.

The manufacture of copper includes a stage, where copper anodes are cast from coarse copper in casting equipment for the electrolytic cleaning of copper. The copper is directed and dosed from a melting furnace to a casting machine through launders and troughs. The launders, which are provided with steel jackets, are lined with refractory material and they are open launders or launders provided with covers. The launders are installed at a suitable inclination so as to effect the flow of melt by means of gravity. To transfer and dose the melt, also troughs, such as a stabilizing trough, are needed, the melt being poured into the stabilizing trough from the melting furnace and the movement of the molten metal being stabilized therein before directing it to the launders. Furthermore, intermediate troughs and dosing troughs are often needed. When increasing the capacity of the casting equipment, the melt launders must be rendered ever longer, causing a bigger problem with cooling and solidification of copper in the launders than before. When the copper solidifies in the launder, the molten flow of the melt is prevented and the molten metal flows over the launder. To prevent solidification, the molten copper is heated to a sufficiently high temperature in a melting reactor so that the temperature of the molten metal keeps the metal running and the launder hot up to the casting machine. The launders are lined with refractory material, its wear being directly proportional to the temperature of the metal that is conveyed: the higher the temperature of the melt, the quicker the lining of the launders wear. Naturally, this brings about extra maintenance costs. The solidification of the melt in the launders is especially probable at the initial stage of casting, when the launders are still cold.

At the end of the casting, the launders and troughs cool quickly, whereby the molten metal in them solidifies. Similarly, in connection with any process disturbances, the flow of molten metal in the troughs and launders may be interrupted or reduced to the extent that the metal solidifies and the entire launder system should be serviced before continuing the casting or beginning a new casting.

Previous attempts to solve the described technical problem have been based on the use of a gas burner or electrical resistors. The flame of the gas burner has been arranged so as to heat the molten metal, the launder and the troughs. However, the problem is that the burners cannot heat the launders p to melting temperature of copper, and hence, have a cooling effect during casting. So far, it has not been possible to achieve a sufficient heating effect by means of the electrical resistors in the launder mainly because of the excessively high loss of heat.

The American patent specification U.S. Pat. No. 5,744,093 discloses a launder construction used in connection with copper casting, wherein a launder, which has a steel jacket and which is lined with refractory material, is provided with an insulating cover. The extra heating of the launder is implemented by a gas burner. A discharge system for the gases from the launder is arranged in the launder cover. The cover of the launder also works as insulation for the radiation heat released from the launder. One weakness of the launder system presented in the publication is that, as a consequence of the chimney effect, a gas up-flow is formed in the inclined, hot launder that is provided with a cover, whereby the hot metal in the launder cools down. The sealing plug that is presented as a solution to the problem is not suitable for the launder system according to our invention, which exploits stabilizing and intermediate troughs to adjust the flow of molten metal.

The purpose of the present invention is to eliminate the problems of prior art and to provide an improved launder construction for the transfer of molten metal. Another purpose of the invention is to provide a launder and trough construction, which is used to transfer molten metal from the melting furnace to the casting machine reliably and tolerant to interruptions in casting. In particular, the objective is a reliable transfer of copper from the anode furnace to the casting machine of the anodes.

The solution according to the invention to the problems of the prior art is based on the fact that a cover that is provided with electrical resistors is arranged in the melt launder construction, its launders and troughs, heating the launder and the troughs, where the copper flows, and on the fact that the chimney effect that is created in the launder provided with the cover is limited by the stagnation pressure generated at the upper end of the covered launder portion.

The heating covers according to the invention can be fitted to be used, for example, in the molten metal launders, the intermediate troughs, from which the melt is dosed into casting troughs, and the casting troughs, from which the melt is dosed into the casting moulds.

The invention provides considerable advantages. The invention enables the heating of the launder construction with less power compared with traditional burner solutions. The heat production is easy to adjust and local thermal stress is avoided, whereby the cracking of the launder embeddings is also avoided. The tendency to downtime of the casting equipment is reduced, as the casting can be interrupted without a risk of the metal solidifying in the launders and troughs. The invention extends the working life of the embeddings of the troughs and the launders and especially of the anode furnace.

In the launder construction according to the invention, molten metal, such as molten copper, is arranged to flow under gravity in an inclined launder that is lined with refractory material and has a metal jacket, and at least part of the launder and the troughs is covered with an insulating cover. At least one electrical resistor element is arranged in the cover of the launder to heat the launder and to keep the metal melted, and a burner of a hot gas blower is arranged at the upper end of the covered launder portion to provide a stagnation pressure in the launder channel to decelerate the flowing gas or to prevent it from flowing or even make it flow downwards. The covers that are arranged on top of the troughs are used during casting and during the periods between castings and during any breaks in casting. The covers of the troughs are easy to fit in place and remove because of their light structures.

The heating elements can be placed in the cover of the troughs so that the heating elements extend to the area in the pit of the trough, where the melt flows during the process.

The lower part of the launder in the launder construction according to the invention comprises the launder itself, wherein the molten metal flows. The cross section of the launder's space for the melt is, for example, a U-shape that opens and widens upwards. The inner surface of the launder, which is in contact with the molten metal, is defined by refractory material, such as a ceramic wearing composition. A suitable material is a refractory, castable mortar. The refractory material forms a flow channel for the molten metal, which is preferably an upward-widening groove that has a rounded bottom. It is preferable to dimension the flow channel so that, in a normal operating condition, the upper surface of the flowing molten metal extends to a height, which is 10 to 20% of the total height of the flow channel. The outer shell of the launder is preferably made of metal, such as steel. When producing the ceramic lining, the steel shell serves as a mould and facilitates the transportation to the installation site.

The launder construction according to the invention comprises a metal shell, such as a steel jacket, which forms the outer surface of the launder bottom, a refractory lining, which defines a flow channel for the molten metal, and an insulating layer that is arranged between the refractory lining and the metal shell, the insulating layer being considerably better in heat insulation than the refractory lining.

In one embodiment of the invention, the temperature of the copper that flows in the launder is within a range of 1080 to 1300° C. The refractory lining of the flow channel of the launder construction is preferably made so thick that the temperature of the outer surface of its bottom is within a range of 700 to 900° C. in an operating state, where there is copper flowing in the launder. The copper to be cast, which flows in the launder, solidifies at ca. 1070° C. The molten copper penetrates the porous refractory lining and solidifies therein, forming a fixed layer of copper in the lining in a place, where the temperature is in the area of the solidification point of copper. Accordingly, it is preferable to make the refractory lining so thick and to arrange the heat insulation of the launder so that, in the operating state, the temperature range that corresponds to the solidification point of copper is inside the refractory lining. In some other embodiments of the invention, molten aluminium, zinc or metal alloy flows in the launder, whereby the insulations of the launder are constructed to correspond to the melting temperatures of these metals.

According to a preferred embodiment of the invention, the refractory lining of the launder is a separate element, which can be detached as an integral part and replaced so that the thermal insulation and/or the steel shell keeps installed in place. In that case, ceramic wool separates the compound from the steel jacket and makes it easy to replace the compound. The compound is anchored to the steel shell by means of fastening members, such as screws. The anchoring screws are screwed to the nuts, which have been cast in the compound, through the steel shell and the wool insulation.

The preferred temperature gradient described above is provided for the refractory lining, for example, by suitably selecting the thickness and the thermal insulation capacity of the insulation layer that is arranged between the refractory lining of the launder construction and the outer shell. A particularly preferred insulation material for the said insulating layer is ceramic wool insulation. The significance of the insulating layer is essential, as without it, the losses of heat are too great and the power required by the heating resistor will melt the resistor itself. On the other hand, if the insulation is too good, the molten metal, such as copper, is allowed to infiltrate through the ceramic refractory compound and the launder will leak.

The cover of the launder construction according to the invention is arranged on top of the launder so that no significant amounts of gases are able to discharge to the outside from between the cover and the launder, and no losses of heat will occur through radiation or gas flows. The surfaces of the cover and the launder, which are placed against each other, are preferably essentially even, whereby the launder supports the cover continuously at its long edges essentially throughout its length.

The cover of the launder construction according to the invention comprises a metal cover, such as a steel jacket; at least one electrical resistor, which is arranged so as to heat the lower part of the launder; and a insulating layer to prevent the loss of heat by radiation through the metal shell. The heating resistor(s) is (are) located above the flow channel of the launder so that the heat from the resistors radiates essentially without obstruction on the metal, which flows on the bottom of the launder, and on the refractory lining. In the operating state, the electrical resistors are heated to 1100-1300° C. The heat insulation is preferably made of ceramic wool insulation, whereby the insulation may comprise one or more layers of lining. The wool insulation in the cover and the launder preferably comprises aluminium silicate wool, magnesium silicate wool, or aluminium oxide wool, which endures high temperatures.

The heating resistors are thick enough, whereby any creeping and bending caused by the heat are minor. The heating resistor preferably consists of a metal rod or pipe with a round diameter. One or more heating resistors can be arranged in the cover to travel side by side in the longitudinal direction of the launder. The resistors are preferably selected so as to have their operating voltage in the so-called safety voltage area. The resistors are preferably fitted in the cover part on so-called supporting cross-arms, which are arranged in the longitudinal direction of the launder transversely under the resistors. The supporting cross-arms can be metal rods or pipes that are coated with ceramic refractory material.

The cover portion covers part of the launder construction. The superimposed cover and launder constitute a launder channel. In a place, where the launder channel ends at the upper end, i.e., on the side of the incoming metal flow, an opening is formed, through which the gases are discharged as a result of the chimney effect from between the launder and the cover. In the launder construction according to the invention, a gas burner or a hot gas blower is arranged in this place, providing a stagnation pressure to limit or prevent the gas flow that discharges from the launder. The hot gas of the burner or the blower is directed towards the opening between the cover and the lower part, whereby the effect of the stagnation pressure becomes the strongest. The fuel of the burner can be, for example, natural gas or liquid gas. The hot gas burner may be even electrically heated.

The power of the burner or the blower is controlled by means of a thermoelement installed at the lower end of the launder channel. The thermoelement indicates the temperature of the gas space at the lower end of the launder channel and the cooling effect of the cool air flowing into the launder channel. In the launder construction according to the invention, a power control for the heating resistors can be arranged to prevent the resistors from overheating. The thermal insulation material of the launder is used to limit its heat losses to such a level that the heating resistor's own temperature will not exceed its normal operating range.

The invention provides considerable advantages. The invention decreases the need of embedding materials and the maintenance intervals of the launders that are used in connection with copper casting, any downtime caused by the embedding, and the energy used for preheating and heating the melting furnace during casting. As the blocking of the launders during casting is reduced, the casting process becomes more reliable. The cover is lightweight, as there are no cables or gas ducts, which are difficult to detach, connected thereto. Accordingly, the cover can be provided with fixed or detachable lifting members and connected to a lifting mechanism. In this way, the cover is easy to move aside during the maintenance and the replacement of the lower part of the launder.

In the following, the invention is described in detail with reference to the appended drawings.

FIG. 5 is the cross-sectional side view of the casting trough according to FIG. 4.

FIG. 6 is the cross section of the casting trough according to FIG. 6 in the direction B-B.

Figure 1:
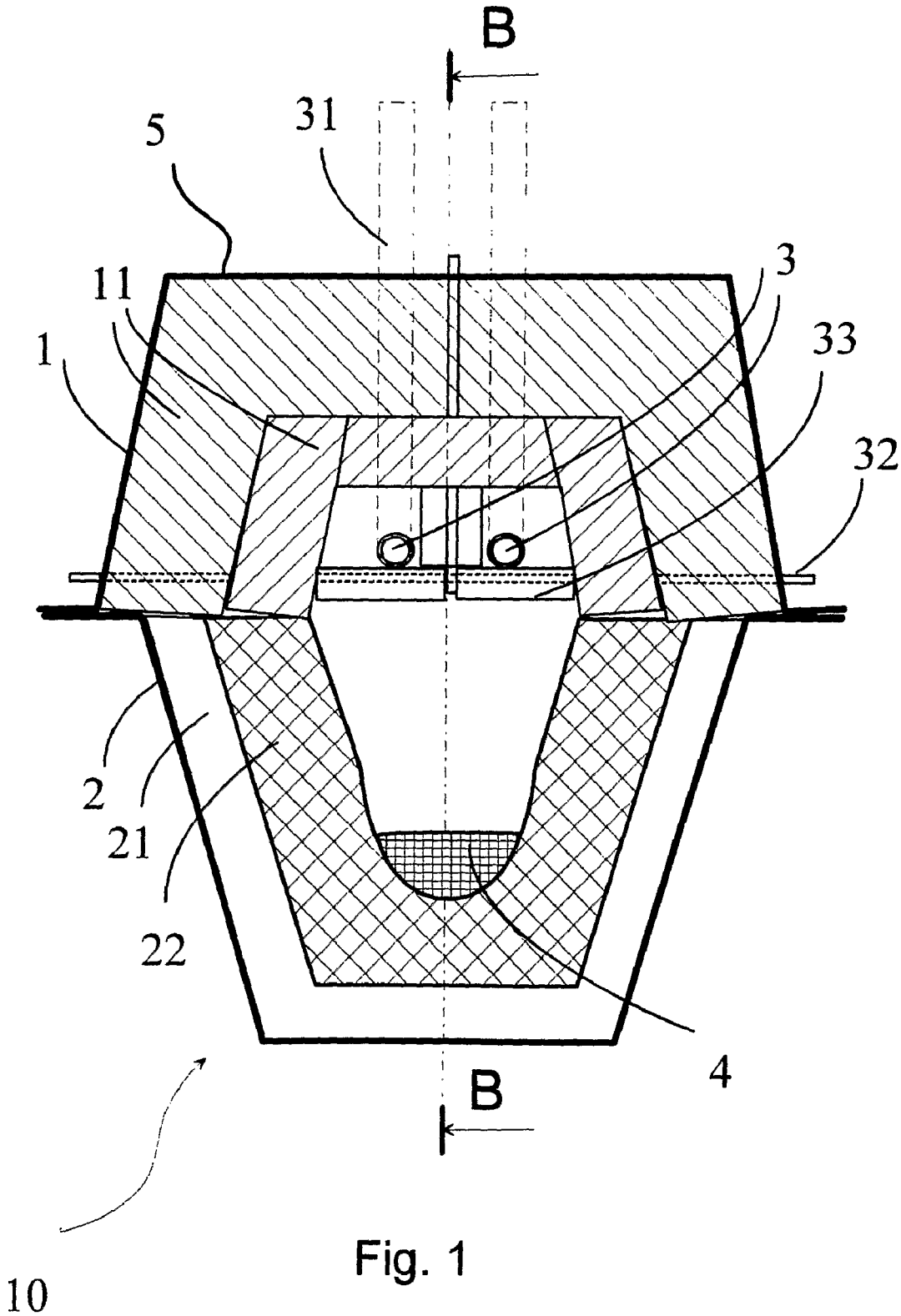
FIG. 1 shows the cross-section of the launder construction according to one embodiment of the invention.

FIG. 1 shows the cover part 5 and the launder construction 10, both comprising a steel jacket 1, 2. A heating resistor loop 3 is arranged on supporting cross-arms 32 in the groove defined by the ceramic wool insulation 11 of the cover 5. The supporting cross-arms 32 are arranged at equal intervals below the resistor loop. A ceramic insulation 33 is arranged in the heatable area of the cross-arms 32. The connecting terminals 31 of the current feed of the heating resistors 32 are taken through the insulating lining 11 of the cover and the metal jacket 1. Molten metal 4 flows in the flow channel formed by a refractory lining 22. The refractory lining 22 is formed of an embedding composition. A layer of ceramic wool insulation 21 is arranged between the refractory lining 22 and the steel jacket 2. The cover 5 rests on the lower part, being supported by the same so that the gas flow and the heat radiation on the long sides of the launder construction are essentially prevented.

Figure 2:
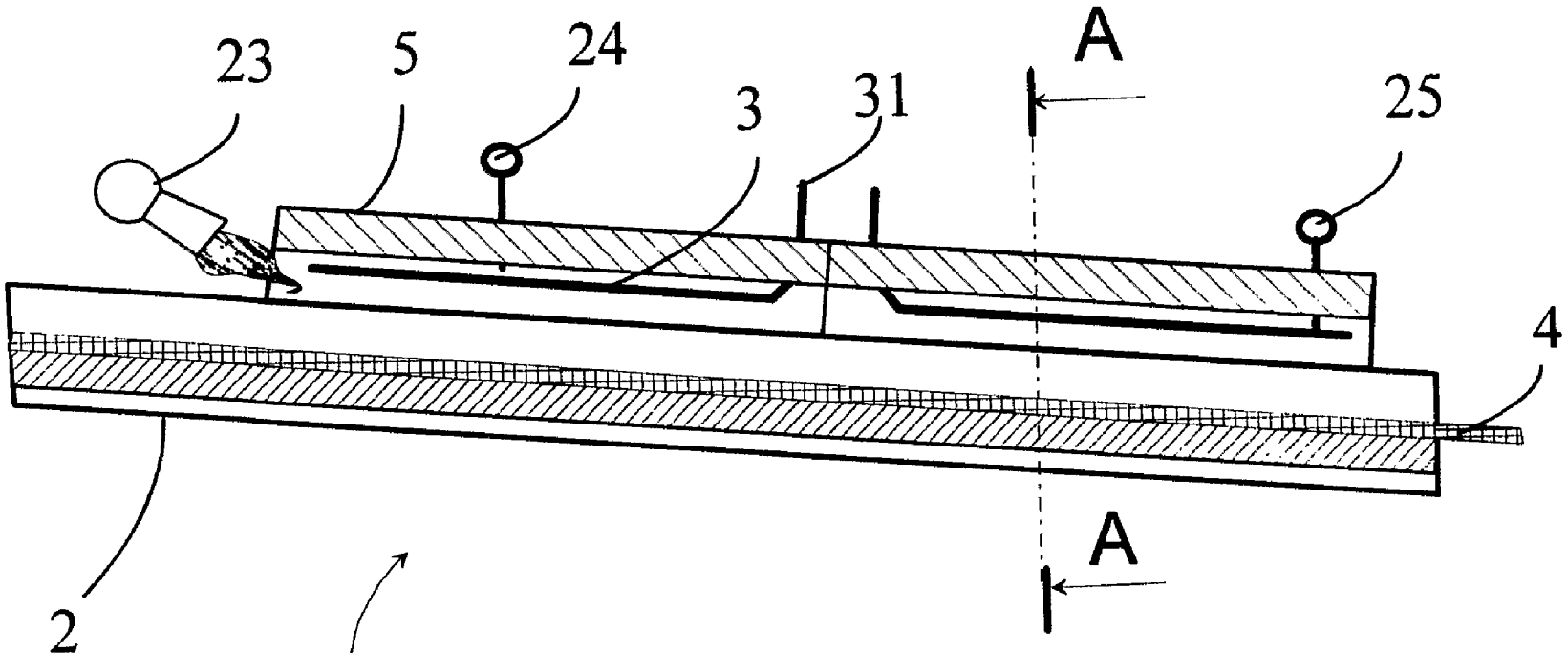
FIG. 2 shows the section of the launder according to FIG. 1 from the lateral direction B-B.

The cover part 5 only covers part of the total length of the launder, as illustrated in FIG. 2. The launder is installed in a slanted position to enable the flow of molten metal in the launder. The cover part and the launder form a launder channel, a gas burner or a hot gas blower 23 being arranged at its upper end, the flow of hot gas being directed at the opening of the launder channel to provide a stagnation pressure, whereby the gas flow in the launder channel is decelerated or prevented.

The heating resistors 3 extend essentially throughout the length of the covered launder portion. A thermoelement 24 measures the temperature of the heating resistor and is arranged in a control circuit, which prevents the temperature resistor from overheating. Such a control that prevents overheating is preferably arranged in connection with each heating resistor. A thermoelement 25 measures the temperature of the cool air flowing into the launder channel and is arranged in a control circuit, which controls the power of the burner or a hot gas blower 23. The cooler the air that flows into the channel, the stronger the chimney effect and the more power is required of the burner 23.

Figure 3:
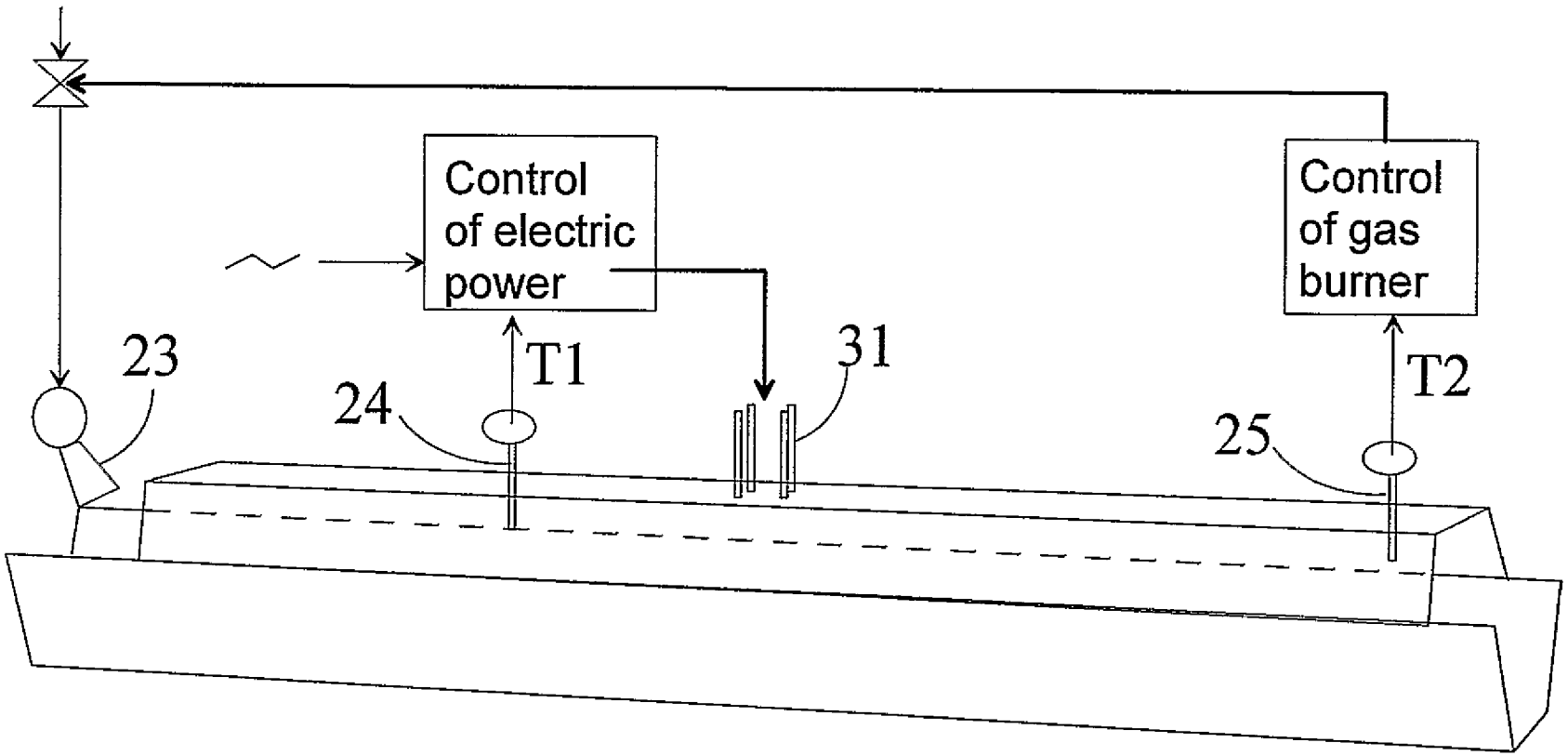
FIG. 3 shows the implementation of the control of a launder construction according to the invention.

In FIG. 3, T1 is a temperature measured by the temperature sensor 24 in the cover of the launder, and T2 is a temperature measured by the temperature sensor 25 at the lower end of the launder, indicating the cooling effect of the gas that flows into the launder channel. The control of the gas burner adjusts the power of the burner or a hot gas blower according to the fluctuation of the cooling effect of the air that flows into the launder. In that case, the stagnation pressure caused by the burner at the upper end of the launder remains suitable throughout the process. The power of the launder cover is adjusted by a separate control of the electric power. The thermoelement T1 measures the temperature in the vicinity of the electrical resistor.

Figure 4:
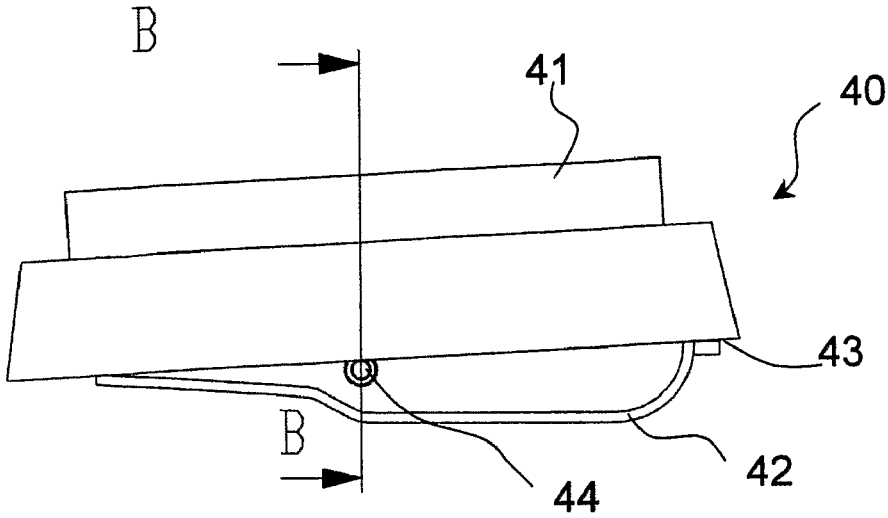
FIGS. 4 to 6 show a casting trough provided with an electrically heated cover.
Figure 5:
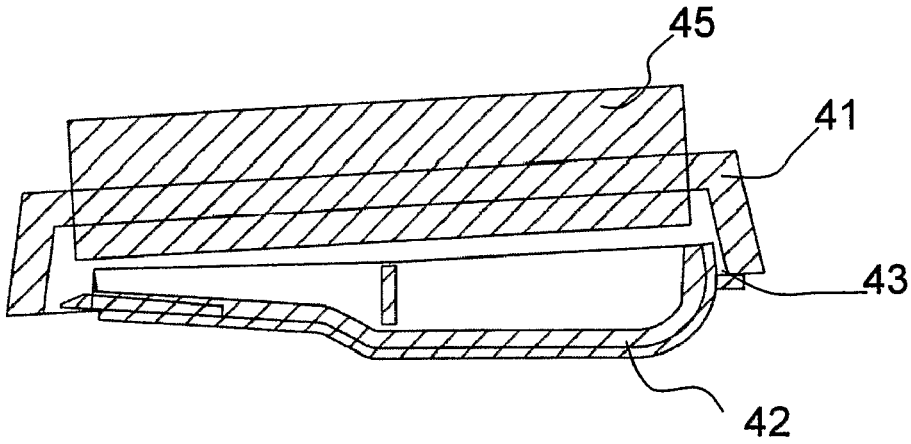
Figure 6:
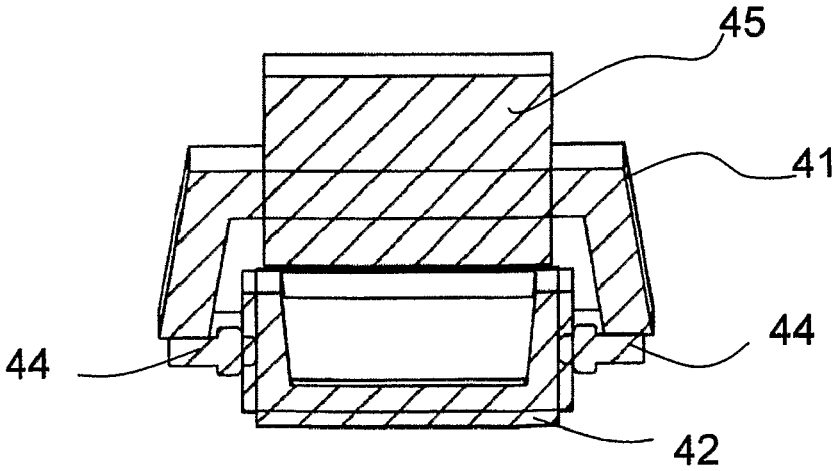

The casting trough 40 of FIGS. 4 to 6 is provided with an insulated cover 41, which is provided with electrical resistances. The resistance material and the associated cabling are arranged in the volume 45, which is formed by the steel jacket of the cover 41. Supports 43, 44 for the cover are arranged on the walls 42 of the casting trough.

The cover 41 that is arranged in the troughs is, for example, a rigid steel framework that supports the electrical heating elements at a suitable distance from the trough 40. The cover preferably has three support points 43, 44, at which it is supported by the trough so that it fits accurately enough in the trough. A layer of heat insulation is provided between the cover 41 and the heating elements. The insulating wool of the cover is suitably soft, whereby the wool settles tightly against the edge of the trough, when the cover is in place, allowing small variations and any solidified metal splatters on the edge of the trough.

It is obvious to those skilled in the art that the invention is not limited to the above description and the solutions according to the appended drawings only. It is also obvious that the launder construction according to the invention is suitable for conveying many kinds of melts.

The invention claimed is:

1. A launder construction for conveying molten metal including:

a lower portion comprising a metal shell having a refractory lining, a cover portion disposed over at least part of the lower portion, the cover portion including at least one electrical resistance heating element for radiating heat toward the covered part of the lower portion, for keeping metal in the covered part of the lower portion in a molten state, wherein the covered part of the lower portion is inclined downward from an upper first end to a lower second end and defines a launder channel for flow of molten metal under gravity from the first end to the second end, and a source of a hot gas flow arranged at the first end of the cover portion for directing the hot gas flow between the cover portion and the lower portion for providing a stagnation pressure to resist flow of gas into the launder channel at the second end of said covered part.

2. The launder construction according to claim 1, wherein the lower portion has longitudinal edges and the cover portion has longitudinal edges that engage the longitudinal edges respectively of the lower portion, whereby gas flow and heat radiation from between the cover portion and the lower portion along the longitudinal edges of the lower portion are substantially prevented.

3. The launder construction according to claim 1, wherein the electrical resistance heating element extends over substantially the entire length of the covered part of the lower portion.

4. The launder construction according to claim 1, wherein the lower part of the launder construction further comprises an insulating layer between the refractory lining and the metal shell, and the insulating layer has a substantially better insulating property than the refractory lining.

5. The launder construction according to claim 4, wherein the insulating layer between the refractory lining and the metal shell comprises ceramic wool.

6. The launder according to claim 5, wherein the ceramic wool comprises aluminum silicate, magnesium silicate, or aluminum oxide wool.

7. The launder construction according to claim 1, wherein the lower part of the launder construction further comprises an insulating layer of ceramic wool between the refractory lining and the metal shell, and the refractory lining is attached to the metal shell by means of releasable fastening members, whereby the refractory lining can be detached and replaced as an integral entity.

8. The launder construction according to claim 1, wherein the heating element is disposed above the launder channel so that heat from the heating element radiates without obstruction onto the metal in the launder channel and onto the refractory lining.

9. The launder construction according to claim 1, comprising a temperature sensor for sensing temperature of the heating element and a control circuit responsive to the temperature sensor for controlling the heating element.

10. The launder construction according to claim 1, comprising a temperature sensor for sensing temperature of gas at the second end of the launder channel and a control circuit responsive to the temperature sensor for controlling the power of the source of the hot gas flow to maintain a suitable stagnation pressure.

11. The launder construction according to claim 1, wherein the source of the hot gas flow is a burner or a hot gas blower.

12. A method of operating a launder construction for conveying molten metal, wherein the launder construction includes a lower portion comprising a metal shell having a refractory lining and a cover portion disposed over at least part of the lower portion, the cover portion including at least one electrical resistance heating element for radiating heat toward the covered part of the lower portion, for keeping metal in the covered part of the lower portion in a molten state, and wherein the covered part of the lower portion is inclined downward from an upper first end to a lower second end and defines a launder channel for flow of molten metal under gravity from the first end to the second end, and the method comprises directing a hot gas flow between the cover portion and the lower portion at the first end of the cover portion for providing a stagnation pressure to resist flow of gas into the launder channel at the second end of said covered part.

13. The method according to claim 12, comprising operating the heating element to maintain its temperature in the range from 1100-1300° C.

14. The method according to claim 12, comprising controlling power of the heating element on the basis of a temperature measured in the vicinity of the heating element.

15. The method according to claim 12, comprising measuring a temperature in the vicinity of the heating element and controlling power supplied to the heating element in response to the measured temperature.

16. The method according to claim 12, comprising measuring a temperature of gas in the launder channel at the second end and controlling the hot gas flow directed between the cover portion and the lower portion at the first end of the cover portion in response to the measured temperature.

* * * * *